United States Patent [19]

Allan

[11] 3,941,668

[45] Mar. 2, 1976

[54] REFRACTORY ORE BENEFICIATION

[76] Inventor: Benjamin W. Allan, 3205 Cornwall Drive, Glendale, Calif. 91206

[22] Filed: July 15, 1974

[21] Appl. No.: 488,510

[52] U.S. Cl. ..... 204/105 R

[51] Int. Cl.[2] ..... C25C 1/00

[58] Field of Search ..... 204/105 R, 280, 291; 75/84, 21, 62, 91, 89

[56] References Cited

UNITED STATES PATENTS

| | | | |
|---|---|---|---|
| 2,537,229 | 1/1951 | McLaren | 75/21 |
| 3,224,870 | 12/1915 | Johnson et al. | 75/91 |
| 3,746,535 | 7/1973 | Brandstatter | 75/91 |

OTHER PUBLICATIONS

U.S. Bur. of Mines Information Circular No. 6365, Oct. 1930, pp. 12–13.

*Primary Examiner*—R. L. Andrews

[57] ABSTRACT

Process for beneficiating ores which contain metallic values in the form of refractory oxides as well as in the form of pyrometallurigically reducible metallic compositions. The portion of the ore which is pyrometallurgically reducible is so reduced to produce a metallic-refractory oxide product. The metallic portion of the product is solubilized by utilizing the product as a consumable anode in an aqueous saline electrolytic cell. A substantially metallic-free refractory oxide product is recovered from the electrolytic cell.

16 Claims, No Drawings

REFRACTORY ORE BENEFICIATION

This invention relates to the production of synthetic refractory ores, particularly titaniferous ores from raw materials in which metallic values are present both as refractory oxide compounds and as pyrometallurgically reducible compounds.

Previously, considerable difficulty had been experienced in the beneficiation of both synthetic and naturally occurring refractory oxide ores. In general, refractory oxide ores occur with several different metallic values contained in them. Usually some of the metallic values are present in the form of refractory oxides and some are present in a form which will admit of their being pyrometallurgically reduced to the metallic state. Particularly, with regard to titaniferous ores, titanium usually occurs as the brookite crystal form of titanium dioxide. The titanium dioxide is present in the ore with other metallic oxides; such as, iron, manganese, nickel, cobalt, copper, chromium, and the like. In general, only the titanium is present as a refractory oxide in the ore so that the other metallic values may be separated from the titanium values by reducing the other values to their metallic state. Procedures for reducing the other metallic constituents in a titaniferous ore are known; however, in general, they are highly undesirable because carrying them out results in substantial pollution problems, as well as substantial corrosion problems. In general, the techniques for removing metallic values from natural and synthetic refractory oxides require the use of or result in the production of acidic solutions or large volumes of metallic salt solutions which are uneconomic to utilize in further processes and are not disposable because of their polluting nature.

In general, there are two primary procedures which are used in the production of titanium dioxide for pigment purposes. These procedures may be characterized conveniently as the sulfate process and the chloride process. The chloride process requires a raw material which is virtually pure titanium dioxide. This material occurs in nature as the ore rutile. The sulfate process uses the titanium ore ilmenite which contains about one atom of iron for each atom of titanium. The refractory titanium oxide is present in the rutile ore in the rutile crystal form which is insoluble in sulfuric acid. In the chloride process the rutile crystal form is digested with chlorine. In the ore ilmenite the refractory titanium oxide is present in the brookite crystalline form which is digestible in sulfuric acid. The sulfate process for the production of titanium dioxide pigment includes a sulfuric acid digestion step for the titanium bearing ore raw material. It is, therefore, not possible to use rutile in the sulfate process. The use of ilmenite in the chloride process is highly undesirable because the chlorination of the iron consumes a large amount of chlorine which is uneconomical to recover. The iron tends to contaminate the titanium dioxide pigment, and the iron usually presents serious pollution problems.

According to the present invention, a virtually iron-free synthetic titanium ore is produced in which the refractory titanium oxide is in the brookite form. Alternatively, a synthetic titanium ore is produced in which the refractory titanium oxide is in the rutile form. These synthetic titanium ores are produced under virtually noncorrosive conditions utilizing inexpensive equipment. These synthetic titanium ores are also produced without the formation of any significant quantity of pollutant material.

According to the present invention, natural and synthetic refractory ores, and in particular titanium bearing ores, are subjected to pyrometallurgical reduction followed by an electrolytic step to substantially increase the refractory oxide content of the material. In general, the pyrometallurgical reduction step reduces the iron and other metallic constituents which are not present as refractory oxides in the raw material to the metallic state. The use of the reduced natural or sythetic ore as a consumable anode in an aqueous electrolytic cell system results in the solubilization of virtually all of the metallic constituents except those which are present as refractory oxides. The metallic constituents which are so solubilized may be recovered as metallic plate at the cathode as hydrous oxides or as dissolved salts. In general, it is preferred to recover the solubilized metallic values as either metallic plate at the cathode or precipitated hydrous oxides because the solid form of this material is easier to handle and has less potential for pollution. When the solubilized metallic values are allowed to remain in solution, some of the same pollution problems that are presented by the sulfate process are encountered in attempting to utilize or dispose of the solubilized metallic values.

The pyrometallurgical reduction of the ore can usually be carried out at temperatures above the 1,000° centigrade in a fluid bed or a rotary kiln using reductants, such as reducing gases and solids. At temperatures of at least about 1,100°0 centigrade the reduction is substantially complete in about 15 minutes. Reducing gases include, for example, hydrogen and gas phase hydrocarbons. Suitable solids include, for example, coal, coke, charcoal, and the like. In general, stoichiometric quantities of the gas or solid reductants, equal to the nonrefractory oxide metallic values present in the natural or synthetic ore, are sufficient to convert these values to the metallic state. The reduction step is carried out in a nonoxidizing atmosphere, and the reduced ore is collected under nonoxidizing conditions and cooled to ambient temperatures so as to avoid reoxidizing the metallic values. Since the major portion of the metallic values are usually iron, it is possible to separate the reduced material from any excess solid reductant or gangue using well-known magnetic separation procedures and equipment. The reduced material which is thus magnetically separated is a metallic-refractory oxide cell feed stock.

The operation of the pyrometallurgical reduction step with the inclusion of an iron oxide stoichiometric reduction step with the inclusion of an iron oxide stoichiometric amount of alkaline reacting material; such as, calcium carbonate, magnesium carbonate, sodium hydroxide, sodium carbonate, or other alkali metal or alkaline earth metal salt, together with the ilmenite ore and the reductant will produce a metallic-refractory oxide material in which the titanium oxide is in the brookite rather than the rutile form. If the alkaline reacting material is not present, the heating of the ilmenite ore will convert the crystalline form of the titanium oxide from the brookite to the rutile. The ilmenite ore which has been reduced in the presence of an alkaline reacting material may be digested by sulfuric acid, whereas that which has been reduced in the absence of an alkaline reacting material cannot be digested by sulfuric acid.

The metallic-refractory oxide cell feed stock is utilized as a consumable anode in an aqueous electrolytic cell for the purpose of solubilizing the metallic portion of the cell feed stock. In general, the purpose of the electrolytic step is to beneficiate the refractory ore without creating any significant pollution problems and without the use of any highly corrosive liquids. If desired, however, the solubilized metallic values may be recovered in an economically useful manner, provided that recovery does not interfere with the beneficiation of the refractory ore and does not create any significant pollution problems. The metallic-refractory oxide cell feed stock may be used as a consumable anode in aqueous electrolytic cells of conventional design. The cell may be constructed of plastic materials because the temperatures at which the cell is operated generally range from approximately 40° to 50° centigrade, and the solute utilized in the cell is a generally noncorrosive salt which does not present serious corrosion problems. The electrodes may be constructed of conventional materials; such as, stainless steel, graphite, lead, carbon, and the like. If desired, the cell may be constructed so that the electrodes are horizontal, and the cell feed stock is placed on the anode at the bottom of the cell. The electrodes may be disposed generally vertically in the cell with the cell feed stock being suspended in the electrolyte by agitation. The fine particles of cell feed stock suspended in the electrolyte constantly come into contact with the current carrying, nondestructive anode where the desirable solubilization of the metallic values takes place. No adverse effect results from the ore coming into contact with the cathode. A partitioned cell having anode and cathode compartments may be utilized if desired.

The form in which the solubilized metallic values are recovered from the electrolytic step is dictated by the choice of solute. The use of sodium salts results in the formation of a caustic at the cathode which reacts with the solubilized metallic values to produce a hydrous oxide which precipitates as a very fine solid. The fine hydrous oxide precipitate is readily separable from the beneficiated refractory oxide because of differences in density, particle size, and settling rates. Various conventional operations; such as, filtration, classification, and elutriation, may be used to separate the beneficiated refractory oxide from the hydrous oxide. When sodium chloride is used as the solute, the reaction between the caustic and the iron chloride at the cathode regenerates the sodium chloride. The use of a solute in the aqueous electrolyte which contains iron may result in the plating out of iron at the cathode. Suitable iron solutes include ferrous sulfate, ferrous ammonium sulfate, ferrous chloride, and the like. Ferrous sulfate and ferrous ammonium sulfate are generally the most widely used solutes in aqueous iron plating baths. The use of ammonium salts, such as ammonium chloride and ammonium sulfate, results in most of the solubilized iron remaining in the cell solution. The ammonium salts are generally the least preferred solutes because their usage results in the formation of an aqueous iron solution which is difficult to dispose of and is generally not suitable for further economic usage.

In general, the titaniferous ores; such as, ilmenite, pseudobrookite, and the like, occur in combination with other minerals and with other metallic compositions as impurities. As a result, the operation of the electrolytic cell produces a number of solubilized metallic values in addition to the iron which is normally present. These additional solubilized metallic values generally follow the iron so that they are plate out, precipitated as hydrous oxides or left in solution together with the iron. In general, the materials, which are removed from the refractory oxide in the electrolysis procedure include iron, manganese, nickel, cobalt, copper, chromium, alkali metals, and alkaline earth metals. When synthetic titaniferous ores, such as highly reduced titanium slags, are used, the concentrations of the metallic impurities are usually lower, but they are still present in the synthetic ore. Titanium slags are produced, for example, by heating ilmenite under reducing conditions to the point where it is rendered fluid, at which point the refractory oxide forms the slag, and the iron and other metallic values are drawn off as molten metal. The slag product may be usable directly as the cell feed stock because the iron in the slag has been pyrometallurgically reduced in the smelting process. The titanium dioxide in the slag is in the brookite crystal form. This titaniferous slag is generally produced in an arc furnace utilizing an iron ore which contains a significant percentage of titanium. The smelting is carried out utilizing an alkali or alkaline earth salt as a flux. The more dense iron settles to the bottom of the molten admixture and is withdrawn.

In the operation of the cell, conventional cell additives may be included, as desired. Such conventional cell additives include, for example, boric acid, various dispersants, antifoaming agents, and the like.

In general, it is preferred to operate the cell with the solute at about its saturation concentration for the minimum operating temperature of the cell. In general, the operating temperature of the cell is maintained at or below about 50° centigrade so as to reduce the rate of evaporation from the cell and to minimize the corrosive attack on the materials of the cell construction.

If the cell is operated so that it is inefficient and less than 100 percent of the current as applied to the solubilization of the metallic values at the anode, the overall efficiency of the operation is not seriously impaired. The inefficient operation of the cell results in the generation of an acid at the anode, which, in the case of a sulfate solute, is sulfuric acid and in the case of a chloride solute is hydrochloric or hypochlorous. These acids which are generated at the anode during inefficient cell operation are consumed in attacking the metallic values within the metallic-refractory oxide consumable anode material. If desired, it would be possible to operate the cell very inefficiently so that the primary product produced at the anode would be an acid which would in turn digest metallic values in the consumable anode material. Such an operation would be, however, less preferred than the efficient operation of the cell.

The natural and synthetic ores which are amenable to use in the present process include, as a class, those ores which contain pyrometallurgically reducible metallic impurities. The metallic impurities are necessary in the operation of the electrolytic cell because it is these metallic values which carry the electrical current that is necessary to accomplish the desired solubilization in the electrolytic process.

The efficiency of the electrolytic step in beneficiating the refractory oxide material is to a large extent dependent upon the accomplishment of as complete a reduction as possible in the pyrometallurgical reduction step. If the iron and other metallic values in the ore are not reduced as completely as possible to the metallic state, the product obtained from the electrolysis step will not have the desired degree of purity. It is possible to operate the electrolytic cells under extreme conditions of time and current density so as to compensate somewhat for a less than complete reduction in the pyrometallurgical reduction step; however, this is very inefficient and is not as effective as a more complete reduction step would be. In general, as complete a reduction as possible is accomplished by operating the kiln or fluidized bed in an efficient manner so that good contact is obtained between the reductant and the pyrometallurgical reduction step feed stock. If necessary, stoichiometric excesses of reductant and extended times may be utilized to accomplish substantially complete reduction. Care should be taken in the recovery of the reduced product to insure that reoxidation does not occur before the product is cooled.

Preferably, the electrolytic cell is operated so that the solubilized metallic values are recovered by being plated out in the metallic state at the cathode. This provides a metallic product which has a further economic value and also eliminates any pollution problems that might result from disposing of the metallic values in some other way. The recovery of the metallic values as a hydrous oxide precipitate is advantageous where there is no economic value to the metals which might be recovered from a plating procedure or where the plating operation cannot advantageously be carried out. The recovery of the solubilized metallic values in the dissolved state is available as an alternative where it is not feasible to either plate or precipitate these metallic values.

The process of this invention may be applied to the beneficiation of a wide variety of refractory oxide ores in which there are pyrometallurgically reducible metallic impurities. Various refractory oxide materials occur in both natural and synthetic ores in admixture with contaminant metallic compositions which are pyrometallurgically reducible. Such refractory oxides which may be beneficiated according to the present invention include, for example, silica, alumina, zirconium oxide, hafnium oxide, thorium oxide, and vanadium oxide. Alumina in the form of oxide ores often includes iron contaminants that are removable according to the present procedure. The requirements for pure thorium materials in nuclear applications may be satisfied in substantial part by beneficiating the synthetic or natural thorium oxide refractory materials according to the present invention. A very pure silica for the manufacture of glass may be produced according to the present invention.

In the following specific examples all parts and percentages are by weight unless otherwise indicated.

EXAMPLE I

This example was conducted to demonstrate that the process could be practiced to beneficiate ilmenite.

Lakehurst ilmenite in the form of a fine (−20 mesh) black sand was roasted under oxidizing conditions in a tube furnace at 1,100° centigrade for a period of about 1 hour. The oxidation was carried out to break the crystalline structure of the ilmenite. The resultant roasted ilmenite sand was pyrometallurgically reduced in a tube furnace using the following procedure. Thirty-five grams of powdered vegetable charcoal was thoroughly admixed with 35 grams of the roasted ilmenite ore and 2 grams of calcium oxide. This charcoal-roasted ore-calcium oxide intimate admixture was placed in a silica tube. The tube was then placed in a tube furnace which had been preheated to 900° centigrade. There was an initial exothermic rise of about 50° centigrade, and after 20 minutes the temperature was 1,100° centigrade. The temperature after an additional 20 minutes was about 1,050° centigrade. After a further period of 40 minutes, the temperature had fallen to 1,000° centigrade, whereupon the furnace was turned off, after a total operating time of about 80 minutes. The tube was left in the tube furnace with the muffle closed and was allowed to cool overnight so as to avoid reoxidizing the metallic portion of the pyrometallurgically reduced product. The cooled product was subjected to a wash with detergent water to float the excess charcoal away from the reduced product. The residue was filtered and was then mixed thoroughly to insure uniformity. The dried product was tested with a magnet and it was found that virtually all of the particles adhered strongly to the magnet. An electrolytic cell was prepared as follows. A 1,000 milliliter beaker was selected and 225 milliliters of 5 weight percent ferrous ammonium sulfate solution were placed in the beaker. A one-half inch diameter carbon rod was selected for the anode, and a 1 inch wide stainless steel spatula was selected for the cathode. An extraction thimble was placed around each of the electrodes. A 5 gram portion of the dried mixed reduced product was placed in the extraction thimble in contact with the carbon rod anode. Electrolysis was commenced using 5 volts at 0.5 amps. Electrolysis was continued under these conditions for about 1 hour and 40 minutes. During the electrolysis, the pH of the aqueous electrolyte in the cell was about 3. The round carbon anode was rotated occasionally to insure good contact with the reduced product. Each of the electrodes was immersed in the cell electrolyte to a depth of about 1½ inches. After 1 hour and 40 minutes of electrolysis, the electrolysis was discontinued and it was observed that there was a small amount of red oxidized iron floating on top of the liquid in the cathode thimble and that there was a small amount of green precipitate on the bottom of the cathode thimble. There was a thin gray mat of iron plated on the stainless steel cathode. The iron was dissolved from the cathode in hydrochloric acid. The anodic residue from the extraction thimble surrounding the carbon rod anode was dried and tested for magnetic attraction with a magnet. It was found that only a few particles adhered to the magnet and that these particles only adhered weakly to the magnet.

The preoxidation of the Lakehurst ilmenite to break the crystal structure contributed significantly to permitting complete reduction to take place in the pyrometallurgical reduction step. This in turn permitted the electrolysis to proceed with ease to the point of substantial completion.

EXAMPLE II

A sample of domestic ilmenite ore having the following analysis:

| Constituents | Percent by Weight |
|---|---|
| $TiO_2$ | 60.0 |
| FeO | 6.0 |
| $Fe_2O_3$ | 25.0 |
| $Al_2O_3$ | 2.1 |
| MnO | 1.2 |
| $SiO_2$ | 1.0 |
| MgO | 3.0 |

-continued

| Constituents | Percent by Weight |
|---|---|
| CuO | 0.5 |

was mixed with 20 weight percent of its weight of ground charcoal and heated in a nonoxidizing atmosphere at 1,100° centigrade for 2 hours. After cooling, out of contact of air, the sample was separated from unreacted charcoal and was analyzed. It was found that substantially all the iron had been reduced to the metallic state to produce a metallic-refractory oxide. This reduced product was added to the anode compartment of a partitioned electrolysis cell having a cathode made of stainless steel in the form of a flat plate 3 inches square and an anode of carbon in the form of a round rod having a 1¼ inch diameter. The cell solution consisted of a 10 weight solution of ferrous ammonium sulfate. After electrolyzing for 2 hours, at 3 amps and 4.5 volts, during which time the ilmenite was kept in suspension at the anode by agitation, it was found that substantially all of the iron in the ilmenite was leached out of the ilmenite and plated on the cathode. The only iron remaining in the beneficiated refractory oxide appeared to be in the form of iron oxide which had not been reduced in the pyrometallurgical reduction step. Cell temperature was 40 degrees centigrade.

After separating from the cell liquors, the washed and dried beneficiated ilmenite, upon analysis, had the following composition:

| Constituents | Percent by Weight |
|---|---|
| $TiO_2$ | 96.3 |
| Fe (total) | 1.8 |
| $Al_2O_3$ | 3.0 |
| $SiO_2$ | 1.6 |
| MgO | 0.4 |
| MnO | 0.1 |

X ray analysis showed the refractory oxide product to be rutile. The refractory oxide product was not soluble in sulfuric acid.

EXAMPLE III

A sample of the reduced metallic-refractory oxide ilmenite, as used in Example II, was transferred to a stirred, nonpartitioned cell having both the cathode and anode made of round inch and one-quarter diameter carbon rod and containing a 20 weight percent of sodium chloride. After electrolyzing at 5 amps and 3.5 volts for 1½ hours, during which time the pH of the solution rose to 9.5, it was found that the cell liquor contained a large quantity of a brown voluminous precipitate. Analysis showed that the precipitate consisted primarily of iron hydroxide, along with some manganese hydrate and trace amounts of other hydrous oxides. The electrolyzed ilmenite, after filtration from the cell liquor and washing, was found to have the following composition:

| Constituents | Percent by Weight |
|---|---|
| $TiO_2$ | 94.3 |
| Fe (total) | 3.2 |
| $Al_2O_3$ | 2.7 |
| $SiO_2$ | 1.5 |
| MgO | 0.3 |

-continued

| Constituents | Percent by Weight |
|---|---|
| MnO | 0.2 |

EXAMPLE IV

A sample of Australian ilmenite having the following analysis:

| Constituents | Percent by Weight |
|---|---|
| $TiO_2$ | 55.40 |
| FeO | 22.50 |
| $Fe_2O_3$ | 18.30 |
| MnO | 1.36 |
| $Al_2O_3$ | 0.40 |
| $SiO_2$ | 1.55 |
| MgO | 0.20 |

was calcined under oxidizing conditions to convert all the iron to the ferric state and to render the ore more amenable to reduction and then reduced with producer gas in a fluid bed at 1,025° centigrade until the iron was substantially converted to metal. This material was next added to a non-partitioned cell having a flat carbon anode placed horizontally at the base of the cell and a perforated flat carbon cathode positioned parallel to and above the anode and at a distance of about 4 inches above the ilmenite sand layer, which had been placed on the upper side of the anode. Ultrasonic agitation was applied to maintain the ilmenite in a fluidized condition. The cell solution was a 15 weight percent solution of ammonium chloride. The pH of the solution was slightly acidic during the electrolysis which continued for 2 hours at about 3.0 volts and 3.5 amps. A small quantity of iron was deposited in the cathode, but the bulk of the iron was found in the cell solution as iron-ammonium chloride. After the beneficiated ilmenite was removed from the cell and washed by decantation, it was found to have the following composition:

| Constituents | Percent by Weight |
|---|---|
| $TiO_2$ | 96.5 |
| Fe (total) | 2.3 |
| MgO | 0.1 |
| MnO | 0.15 |
| $SiO_2$ | 1.6 |

EXAMPLE V

Another sample of the preroasted reduced Australian ore of Example IV was similarly electrolyzed but a 10 weight percent solution of sodium sulfate was used in the cell in place of the ammonium chloride. Unlike the results in the prior experiment, the cell liquor became alkaline (pH 11.0), and the iron and other hydrate-forming metal oxides precipitated in the cell liquor. Nevertheless, the electrolyzed ilmenite had approximately the same composition as the sample electrolyzed with ammonium chloride. Cell temperature was about 45° centigrade.

EXAMPLE VI

A sample of highly reduced titanium slag obtained from smelting titaniferous iron ore under reducing conditions in the presence of calcium oxide was added to a nonpartitioned cell containing a 12 weight percent solution of ammonium chloride and electrolyzed for 2.5 hours at 3.5 volts and 2.1 amps. At the end of this time the beneficiated slag was removed from the cell, washed and dried and analyzed. The product was of the following composition.

| Constituents | Percent by Weight |
|---|---|
| $TiO_2$ | 90.90 |
| Fe (total) | 1.24 |
| MgO | 2.50 |
| $SiO_2$ | 2.20 |

X ray analysis showed the refractory oxide product to have the pseudobrookite crystal form.

EXAMPLE VII

In this experiment Indian ilmenite ore was mixed with 30 percent by weight of wood charcoal, plus 35 percent by weight of magnesium carbonate, and calcined under nonoxidizing conditions at 1,150° centigrade for 1 hour. After calcination, the reduced ore was magnetically separated from the unused carbon residue. The separated ore was then used as a consumable anode in an aqueous saline electrolytic cell system, employing ammonium chloride as solute. After electrolyzing for 2 hours at 3.5 amps and 4 volts, the ore residue was filtered, washed free of salt, dried and, on analysis, was found to contain 90.5 weight percent $TiO_2$ and 3.2 weight percent iron. X ray analysis showed the $TiO_2$ crystal structure was pseudobrookite with no rutile present. The ground product was soluble in sulfuric acid.

EXAMPLE VIII

In this experiment Indian ilmenite ore was blended with 25 percent by weight of an equi-molar mix of sodium hydroxide and sodium carbonate, plus 30 percent by weight of petroleum coke and calcined at 1,150° centigrade for 1.5 hours. After separating the calcined ore from the unused coke, it was used as the consumable anode in an aqueous saline cell employing sodium chloride as the solute. After removal from the cell, the ore analyzed 92 weight percent $TiO_2$, 4.1 weight percent iron, and, by X ray, analysis was of the pseudobrookite crystal structure. It was soluble in sulfuric acid.

The preroasting of the synthetic or natural ores accomplishes two objectives. First, the preroasting oxidizes the ferrous iron to the ferric state. Second, the preroasting tends to open up the crystal structure so as to facilitate the reduction step. Both the opening of the crystal structure and the conversion of the ferrous to the ferric state tend to increase the percentage of the iron oxide which is reduced completely to the metallic state in the reduction step.

In general, it is preferred to carry both the reduction and electrolysis steps to substantial completion. It has generally been found that it is impossible to reduce all of the metallic oxide to the metallic state so that the electrolysis does not remove all of the undesired metallic contaminants. In general, it is possible to carry the electrolysis step substantially to completion so as to remove all of the metallic contaminants which are present in the metallic state. In some instances where small amounts of impurities may be tolerated in the end use to which the beneficiated refractory may be put, it is possible to operate the reduction and electrolysis steps under conditions such that a major portion, but less than substantially all, of the metallic contaminants are removed. According to the present process, the degree of purity may be adjusted either through incomplete reduction or incomplete electrolysis, depending upon whether it is desired to retain the metallic impurity in the oxide or the metallic state.

In general, the purpose of the present process is to beneficiate the refractory oxide and the recovery from the electrolysis step of the solubilized metallic values in an economically useful form is an added benefit. The electrolytic cell is, therefore, operated primarily for the purpose of solubilizing the metallic values in the reduced metallic-refractory oxide cell feed stock. In general, it has been found that the solute for use in solubilizing the metallic values in the consumable anodic material may be selected from acidic, slightly acidic, neutral, or basic salts; such as, sodium bisulfate, ammonium chloride, ammonium sulfate, ammonium nitrate, ferrous ammonium sulfate, ferrous chloride, ferrous sulfate, sodium sulfite, sodium sulfate, sodium chloride, sodium nitrate, and the like. As indicated previously, the preferred solutes are those which minimize pollution problems by providing the solubilized metallic values in the form of solid phase materials. From an economic standpoint, the neutral salts, such as sodium chloride and sodium sulfate, are preferred. Conventional electrolytic cell solutes are utilized in the process. In general, the concentration of the solutes is kept as high as possible without incurring the risk of precipitation in the bath at room temperature. The risk of undesired precipitation is avoided if the concentration of the solute is maintained below about saturation at 20° centigrade. The solutes may be used in very dilute solutions, if desired, but in general this does not result in an economic operation. The temperature of the cell is generally between approximately 40° and 60° centigrade, and in any event is below the boiling point of the electrolyte. The invention may be practiced in cells of conventional design in either batch or continuous operations. In general, it is preferred to operate the electrolytic cell so that the solubilized metallic values are recovered substantially in all one form or another. However, if desired, the cell may be operated so that some of the metallic values are plated out of the cathode and some are precipitated as hydrous oxides. The cell design and operation may be carried out according to conventional procedures in order to recover the solubilized metallic values in the desired form so long as the cell is operated so as to accomplish the primary purpose of beneficiating the refractory oxide.

The embodiments in which an exclusive right is claimed are defined in the following claims.

What is claimed is:

1. A method of producing synthetic refractory oxide ore comprising:

subjecting a refractory oxide ore which includes pyrometallurgically reducible metallic values to pyrometallurgical reduction to produce a metallic-refractory oxide product, the metallic portion of said metallic-refractory oxide product being the reduced product of said pyrometallurgically reducible metallic values; and utilizing said metallic-refractory oxide product as a consumable anode in an aqueous saline electrolytic cell to solubilize at least a substantial part of the metallic portion of said metallic-refractory oxide product.

2. A method of claim 1 including carrying the pyrometallurgical reduction to substantial completion.

3. A method of claim 1 including solubilizing substantially all of the metallic portion of said metallic-refractory oxide product.

4. A method of claim 1 including removing substantially all of the pyrometallurgically reducible metallic values from the refractory oxide ore.

5. A method of claim 1 including calcining the refractory oxide ore under oxidizing conditions before subjecting said refractory oxide ore to pyrometallurgical reduction.

6. A method of beneficiating ores which contain metallic values in the form of both refractory oxides and pyrometallurgically reducible metallic compositions comprising:

pyrometallurgically reducing the pyrometallurgically reducible metallic compositions in said ores to substantially the metallic state to produce a metallic-refractory oxide, the metallic portion of said metallic-refractory oxide being the reduced product of said pyrometallurgically reducible metallic compositions;

solubilizing substantially all of the metallic portion of said metallic-refractory oxide by utilizing said metallic-refractory oxide as a consumable anode in an electrolytic cell; and recovering a substantially metallic-free refractory oxide product from said electrolytic cell.

7. The method of claim 6 wherein the solubilization is accomplished in an aqueous saline electrolytic cell.

8. The method of claim 6 including permitting the solubilized metallic portion to plate out in the metallic state at the cathode.

9. The method of claim 6 including permitting the solubilized metallic portion to precipitate in the electrolytic cell as hydrous oxides.

10. The method of claim 6 including permitting the solubilized metallic portion to remain in solution.

11. The method of claim 6 wherein the ore is a titaniferous ore which includes a substantial amount of iron and the electrolytic cell is operated so as to permit the iron to precipitate as hydrous oxide of iron.

12. The method of claim 6 wherein the ore is a titaniferous ore which includes a substantial amount of iron and the electrolytic cell is operated so as to permit the iron to plate out as metallic iron at the cathode.

13. A method of producing synthetic rutile from ilmenite ore which comprises:

subjecting said ilmenite ore to pyrometallurgical reduction to reduce substantially all of the metallic values in said ilmenite ore, except titanium, to the metallic state to produce a metallic-titanium oxide;

utilizing said metallic-titanium oxide as a consumable anode in an aqueous electrolytic cell, said metallic-titanium oxide being subjected to electrolysis to solubilize substantially all of the metallic portion of said metallic-titanium oxide to produce a synthetic rutile.

14. A method of beneficiating ores which contain metallic values in the form of refractory oxides and pyrometallurgically reducible metallic compositions comprising:

pyrometallurgically reducing the pyrometallurgically reducible metallic compositions in said ores to substantially the metallic state to produce a metallic-refractory oxide, the metallic portion of said metallic-refractory oxide being the reduced product of said pyrometallurgically reducible metallic compositions, said pyrometallurgical reduction being carried out in the presence of an alkaline reacting compound; and subjecting said metallic-refractory oxide to electrolysis to solubilize the metallic portion of said metallic-refractory oxide, thereby producing a refractory oxide which is capable of being substantially solubilized in sulfuric acid.

15. A method of producing a sulfuric acid soluble synthetic titanium oxide ore comprising:

subjecting a titaniferous ore to pyrometallurgical reduction in the presence of an alkaline reacting material to produce a metallic-titanium oxide product in which substantially all of the titanium is present as titanium oxide; and utilizing said metallic-titanium oxide product as a consumable anode in an aqueous saline electrolytic cell to solubilize the metallic portion of said metallic-titanium oxide product thereby producing a sulfuric acid soluble synthetic titanium oxide ore.

16. A method of beneficiating ilmenite ores which contain metallic values in the form of refractory titanium oxide and pyrometallurgically reducible metallic compositions comprising:

pyrometallurgically reducing the pyrometallurgically reducible metallic compositions in said ores to substantially the metallic state to produce a metallic-refractory titanium oxide in which the metallic portion of said metallic-refractory titanium oxide is the reduced product of said pyrometallurgically reducible metallic compositions, said pyrometallurgical reduction being carried out in the presence of an alkaline reacting compound; and subjecting said metallic-refractory titanium oxide to electrolysis to solubilize the metallic portion of said metallic-refractory titanium oxide, thereby producing a refractory titanium oxide which is capable of being substantially solubilized in sulfuric acid.

* * * * *